US006676425B2

(12) United States Patent
Lewis

(10) Patent No.: US 6,676,425 B2
(45) Date of Patent: Jan. 13, 2004

(54) LAMP LENGTH COMPENSATION SYSTEM

(75) Inventor: Randy Kent Lewis, Americus, GA (US)

(73) Assignee: Cooper Technologies Company, Houston, TX (US)

( * ) Notice: Subject to any disclaimer, the term of this patent is extended or adjusted under 35 U.S.C. 154(b) by 77 days.

(21) Appl. No.: 09/994,842

(22) Filed: Nov. 28, 2001

(65) Prior Publication Data

US 2003/0100210 A1 May 29, 2003

(51) Int. Cl.[7] ..... H01R 33/02

(52) U.S. Cl. ..... 439/234; 439/225; 439/232; 439/241

(58) Field of Search ..... 439/234, 240, 439/241, 225, 232, 236

(56) References Cited

U.S. PATENT DOCUMENTS 3,328,577 A * 6/1967 Pistey et al. ..... 439/240
3,594,636 A 7/1971 Gibbs et al.
3,752,977 A 8/1973 Davis
4,070,571 A 1/1978 Robertson et al.
4,198,108 A 4/1980 Bassetto
4,758,173 A 7/1988 Northrop
5,727,869 A 3/1998 Crosby et al.
5,816,837 A 10/1998 Henrici et al.
6,364,679 B1 * 4/2002 Gerstberger ..... 439/241

OTHER PUBLICATIONS

Attachment 1, Spring clip Added to pin Retained Socket.
Attachment 2, Tilting of Socket with Stop By Using Socket Track with no Hole for Stop.
BJB End Mount Lampholder Side Wire.

* cited by examiner

*Primary Examiner*—Truc Nguyen
(74) *Attorney, Agent, or Firm*—Thomas, Kayden, Horstemeyer & Risley LLP

(57) ABSTRACT

In one general aspect, a lamp length compensation system includes a lamp socket, a retention clip, and a flexible member. The retention clip has a movement stop and is mounted to a wall to slideably retain the lamp socket between the wall and the movement stop. The flexible member also is mounted to the wall and flexedly contacts the lamp socket.

32 Claims, 9 Drawing Sheets

LAMP LENGTH COMPENSATION SYSTEM

TECHNICAL FIELD

This invention relates to light fixtures having sockets that accommodate lamps of varying lengths.

BACKGROUND

Light fixtures for use with fluorescent lamps are typically designed to accommodate a fluorescent lamp having a standard length. The typical fluorescent lamp has two pin contacts on each end that mate with electrical contacts in each lamp socket. Installation of the lamp in the lamp sockets can be difficult if the lamp is shorter or longer than the standard length since the lamp must be carefully positioned and rotated within a rigid assembly with close tolerances that may damage the lamp sockets or the lamp if the installation is not performed correctly.

Since the lamp has contacts that must be correctly seated in the lamp socket, an adapter may be used between the socket and the lamp to install a shorter length lamp. Otherwise, the lamp contacts may not maintain proper surface contact with the lamp socket. Without an adapter, the contacts on shorter lamps may be exposed, which can create the potential for electrical shorts or shocks.

SUMMARY

In one general aspect, a lamp length compensation system includes a lamp socket, a retention clip, and a flexible member. The retention clip has a movement stop and is mounted to a wall to slideably retain the lamp socket between the wall and the movement stop. The flexible member also is mounted to the wall and flexedly contacts the lamp socket.

Implementations may include one or more of the following features. For example, the lamp length compensation system may include a pair of retention clips. Each retention clip may include a retention wall and a bottom wall attached to the retention wall to slideably retain the lamp socket. The angle between the retention wall and the bottom wall may define an acute angle.

The lamp socket may include sides having insert wings. The retention clips may slideably retain the insert wings. The lamp socket also may include a slot to insert lamp contacts and contact retainers to retain the lamp contacts.

A platform may be mounted to the wall to support the lamp socket. The lamp socket may have a base and the platform may contact the base to limit the range of travel of the lamp socket between the wall and the movement stop. The lamp socket also may have a lip that contacts the bottom of the retention clip. The lamp length compensation system may be installed as part of a light fixture. The components of the lamp length compensation system may be mounted to a side wall of the light fixture.

In another general aspect, installing a lamp length compensation system includes mounting a retention clip having a movement stop to a wall of a light fixture, mounting a flexible member to the wall, and installing a lamp socket in the retention clip to slideably retain the lamp socket with the flexible member flexedly contacting the lamp socket.

Implementations may include one or more of the features noted above and one or more of the following features. For example, installing the lamp length compensation system may include installing a fluorescent lamp in the lamp socket. Installing the lamp socket may include aligning the lamp socket below the retention clip and sliding the lamp socket toward the retention clip.

In another general aspect, a light fixture may include a wall and a lamp length compensation system. The lamp length compensation system includes a pair of retention clips mounted to the wall and a flexible member attached at one end to the wall.

Implementations may include one or more of the following features. The retention clips may be configured to slideably retain a lamp socket. The retention clips may include movement stops and the retention clips may slideably retain the lamp socket between the wall and the movement stops.

The flexible member may be configured to flexedly contact the lamp socket. The flexible member may include a springboard having a base and a lever. The base may be mounted to the wall and the lever may be configured to flexedly contact the lamp socket. The lamp length compensation system can be configured to allow a light fixture to accommodate lamps of varying length. The lamp length compensation system can be used to retrofit an existing light fixture or it may be incorporated as a component part of a manufactured light fixture.

The details of one or more implementations are set forth in the accompanying drawings and the description below. Other features and advantages will be apparent from the description, the drawings, and the claims.

DESCRIPTION OF DRAWINGS

Like reference symbols in the various drawings indicate like elements.

DETAILED DESCRIPTION

Figure 1:
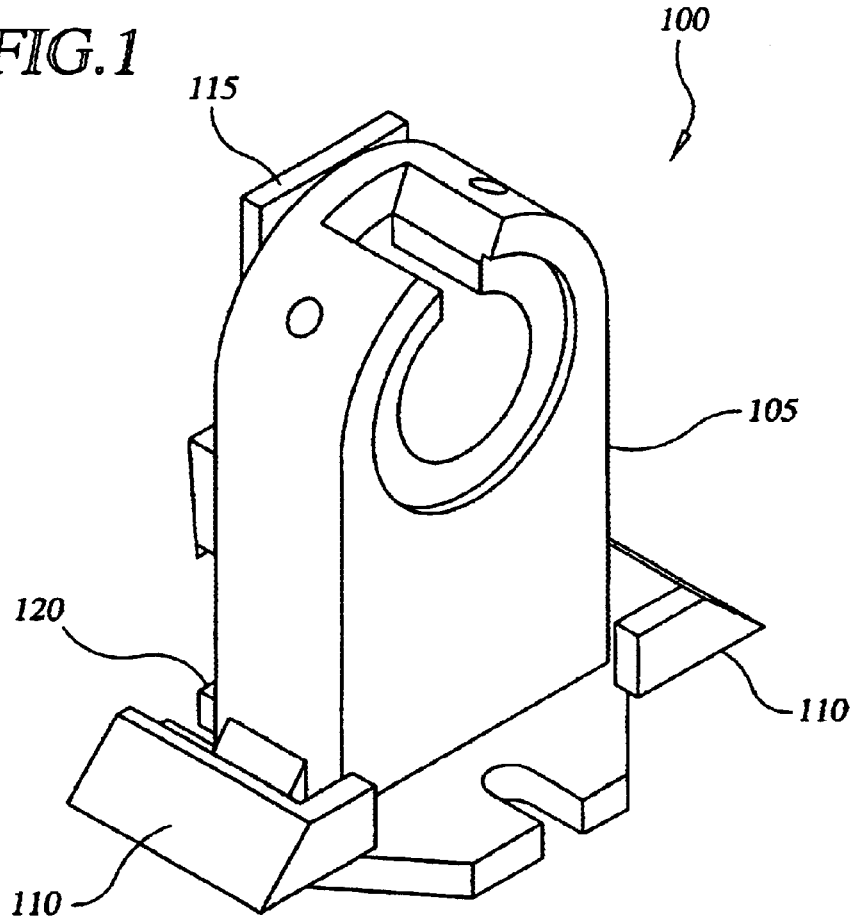
FIG. 1 is a perspective view of a lamp length compensation system.
Figure 2:
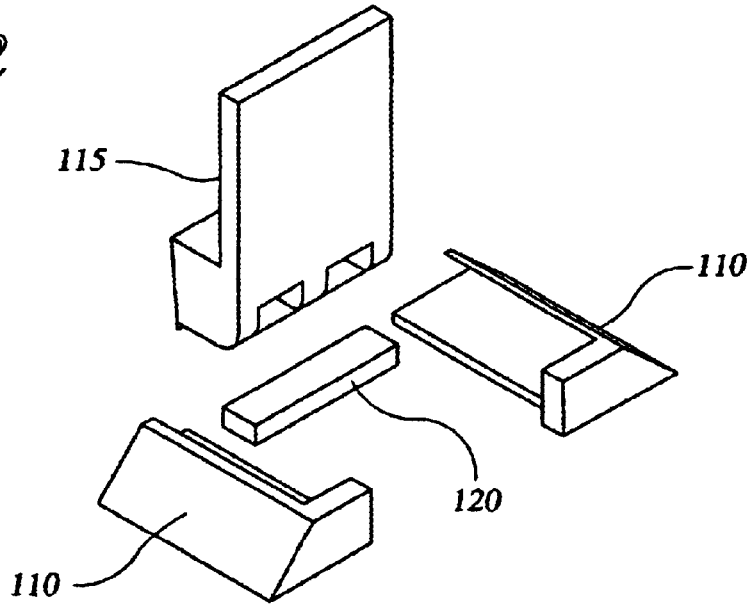
FIG. 2 is a perspective view of retention clips, a springboard, and a platform of the system of FIG. 1.

Referring to FIGS. 1 and 2, a lamp length compensation system 100 includes a lamp socket 105, retention clips 110, a springboard 115, and a platform 120. In general, the lamp socket 105, the retention clips 110, the springboard 115, and the platform 120 are mounted to the wall of a light fixture configured to receive a fluorescent lamp. The lamp sockets 105 are moveably mounted in the system 100 and can be pressed against the springboards 115 to increase the length between the lamp sockets 105.

Figure 3:
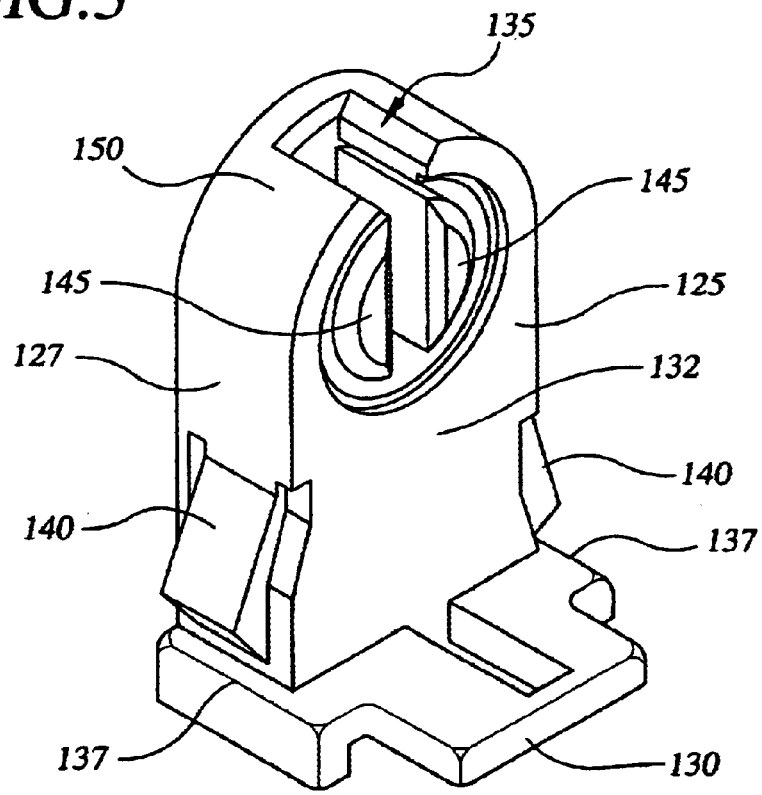
FIG. 3 is a perspective view of a lamp socket of the system of FIG. 1.

Referring to FIG. 3, the lam socket 105 includes a body 125, sides 127, a lip 130, a front 132, a slot 135, insert wings 140, and a contact retainer 145. The body 125 is generally rectangular with an arced top region 150. The slot 135, which is located in the top region 150, provides an opening into the contact retainer 145. The contact retainer 45 is a circular cut-out area formed in the body 125 that provides both electrical and mechanical connections with a lamp (not shown).

The lip 130 is attached to the body 125 on the end opposing the top region 150. The lip 130 is slightly wider than the body 125 on the sides 127 and the front 132 and it is flush with the body 125 on the side mounted to a light fixture side wall. As described below, the wider lip 130 is sized to retain the lamp socket between the platform 120 and the retention clips 110. The insert wings 140 are flexedly attached to the sides 127 of the body 125 approximately mid-way between the lip 130 and the top region 150 and flair outward from the sides 127 in a general direction toward the edges 137 of the lip 130. Because of their flexibility, the insert wings 140 can be pressed against the sides 127, which reduces the profile of the socket 105 such that it can be more easily mounted within the retention clips 110, as described in more detail below. When the wings 140 pass by the retention clips 110, they expand outwardly, which prevents undesired slipping of the socket in the direction from which the socket was mounted. The lip 130 and the insert wings 140 may be integrally formed as part of the lamp socket 105 or the lip 130 and the insert wings 140 may be separately formed and attached to the body 125.

Figure 4:
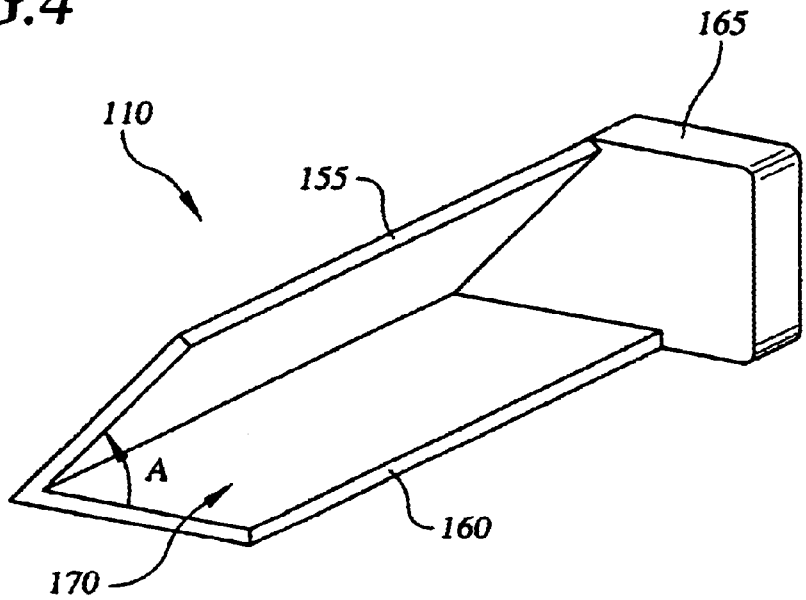
FIG. 4 is a perspective view of a retention clip of the system of FIG. 1.

Referring to FIG. 4, the retention clip 110 includes a retention wall 155, a bottom wall 160, and a movement top 165. The retention wall 155 and the bottom wall 160 are rectangular members of approximately equal size. The retention wall 155 and the bottom wall 160 form a V-shape. The lamp socket 105 is fixed to the retention clips 110 by contact between the retention wall 155 and the insert wing 140 and between the lip 130 and the bottom wall 160. In another implementation, the retention wall 155 and the bottom wall 160 attach to each other in a length wise manner at an approximately 45 degree angle (Angle A) to form a V-shape channel 170 in the retention clip 110. In other implementations, Angle A may have a more acute angle. In a further implementation, Angle A may be a perpendicular or right angle and a top wall (not shown) may be attached to the retention wall 155. The movement stop 165 is attached to an end of the retention clip 110.

Figure 5:
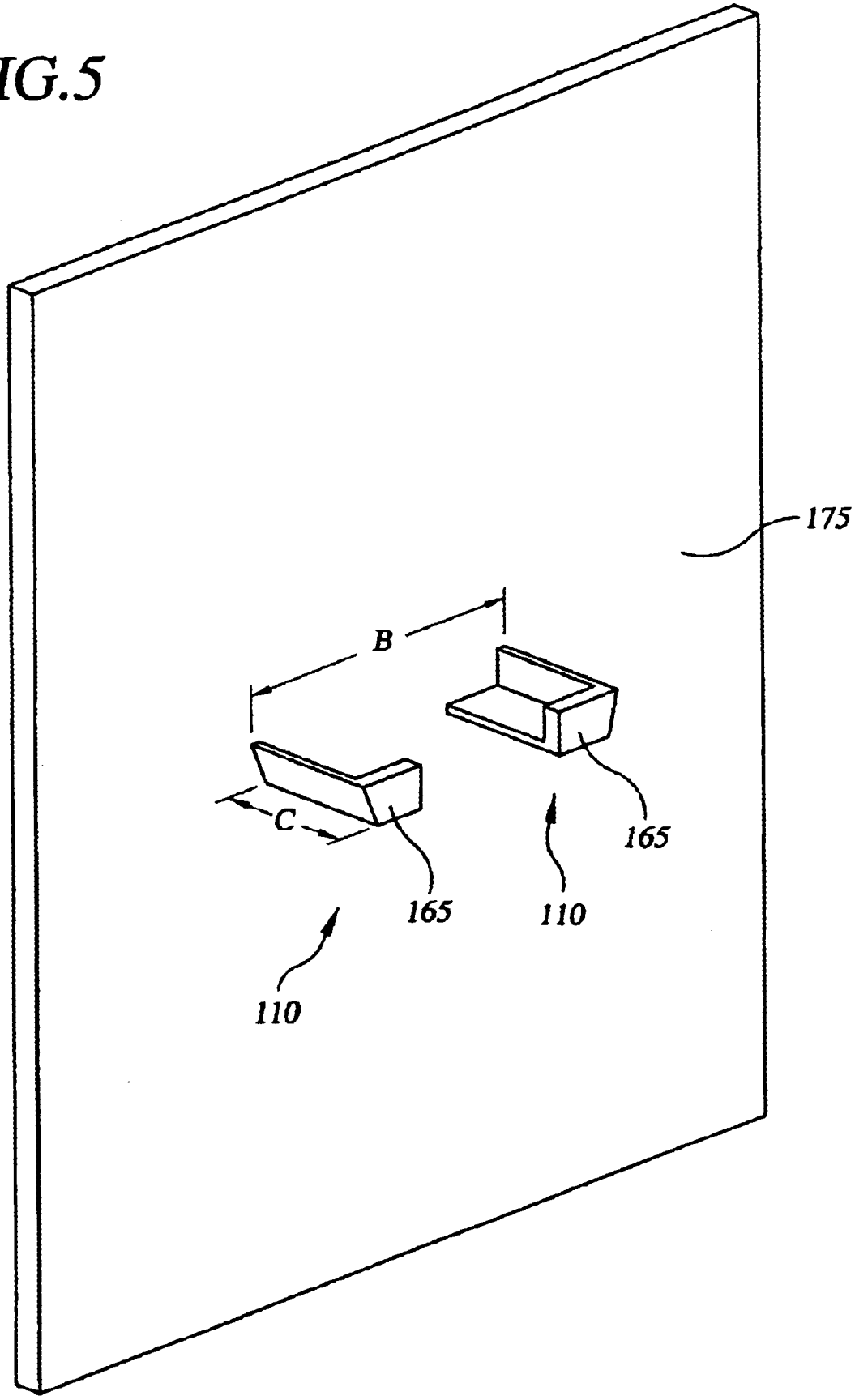
FIG. 5 is a perspective view of retention clips of the system of FIG. 1 attached to a light fixture side wall.

Referring to FIG. 5, the retention clips 110 mount or attach to a side wall 175 of a lamp fixture at the end opposite of the movement stop 165. The retention clips 110 may be formed integrally with the side wall 175 or may be formed separately from the side wall 175 and glued, screwed, mounted with an interference fit, or riveted to the side wall 175. The distance between the retention clips (represented by Arrow B) can be varied to accommodate various sized lamp sockets 105. The length between the side wall 175 and the movement stop 165, (represented by Arrows C), is greater than the width of the installed lamp socket 105.

Figure 6:
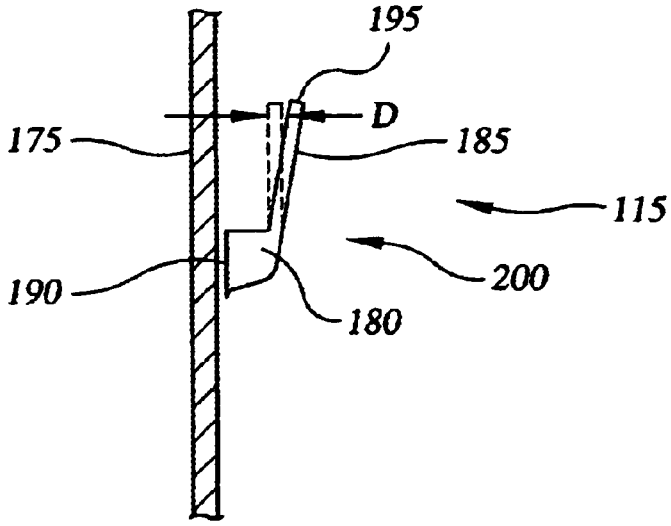
FIG. 6 is a side view of a springboard of the system of FIG. 1.

Referring to FIG. 6, the spring board 115 includes a base 180 and a layer 185. The base 180 has a flat mounting surface 190 (not shown in FIG. 6) that attaches to the side wall 175 of a lamp fixture. The base 180 is made of a thick material in comparison to the lever 185, making the base 180 more rigid than the lever 185.

A gap is formed between the side wall 175 and the lever 185. The lever 185 is biased at an angle of approximately six degrees from parallel with the side wall 175 (represented by Arrow D). Thus, as shown by Arrow D, the tip 195 is farther from the side wall 175 than the secured end 200 of the lever 185. The tip 195 of the lever 185 can be made to flex back toward the side wall approximately 0.08 inches.

In another implementation, the bias angle (Arrow D) may be larger, which causes the tip 195 of the lever 185 to extend further toward the center of the lamp fixture. In a further implementation, the lever 185 may be designed with more or less flexion to alter the range of motion to be more or less than 0.08 inches. For example, the springboard 115 maybe made from a rigid plastic or metal to minimize the range of motion of the lever 185. Alternatively, the springboard may be made from a more elastic material, such as, for example, rubber, to increase the range of motion of the lever 185. In still another implementation, the length of the lever 185 can be varied to vary the range of motion of the lever 185.

The springboard 115 may be formed as one integral component or the base 180 and the lever 185 may be formed separately and then attached together. An advantage of forming the base 180 and the lever 185 separately may include making the base from a rigid material and the lever 185 from a more elastic material. Thus, the base 180 may have additional strength (relative to the lever 185) for attachment to the side wall 175 while the lever 185 may have an additional range of flexion.

Figure 7:
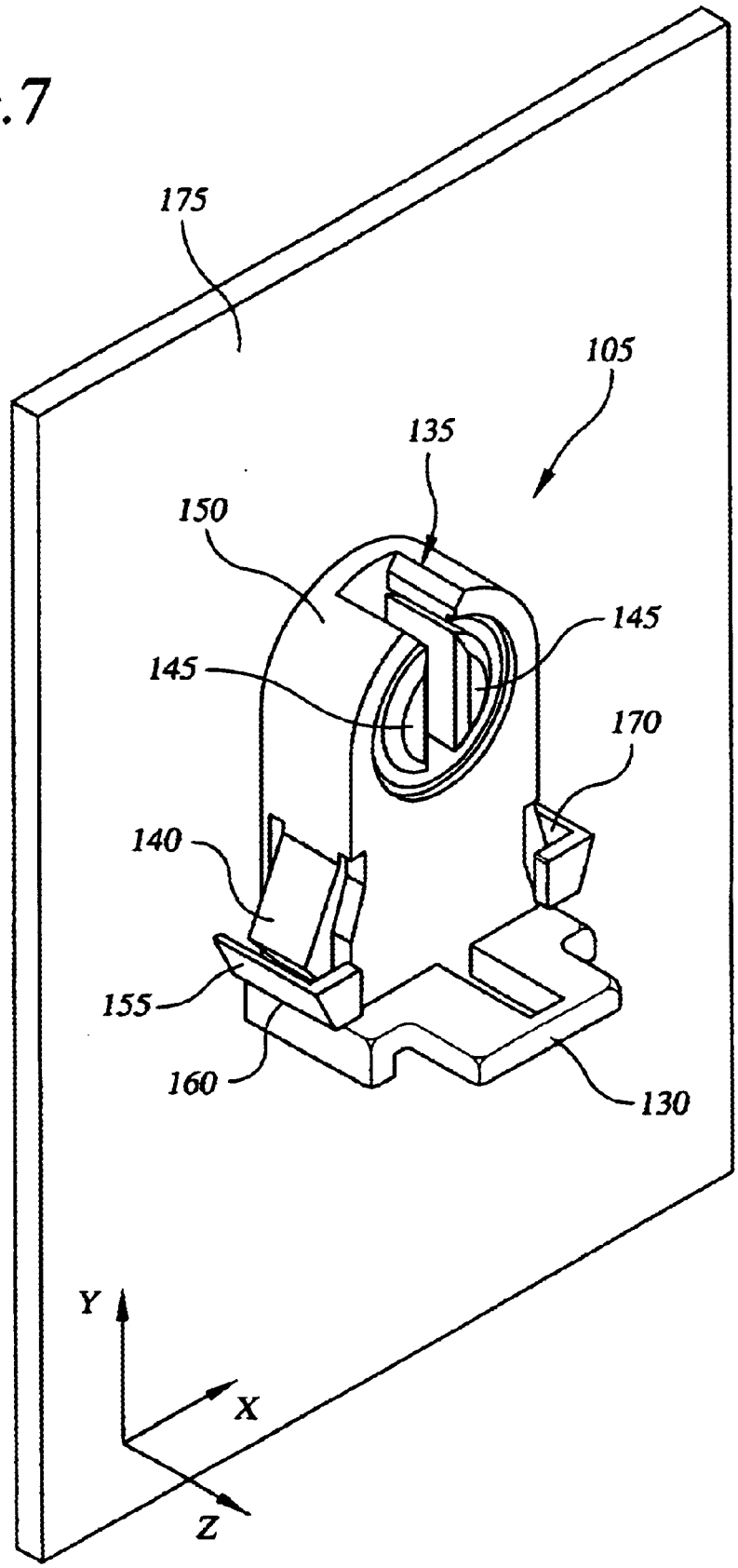
FIG. 7 is a perspective view of a lamp length compensation system attached to a side wall.

Referring to FIG. 7, the insert wings 140 are slideably secured in contact with the retention wall 155 of the retention clips 110 to retain the socket 105. In this position, the lip 130 is below the bottom wall 160 of the retention clips 110. The platform 120 (not shown in FIG. 7) mounts or attaches to the light fixture side wall 175 behind the lamp socket 105 to contact the lamp socket 105 near the lip 130. Thus, the lamp socket 105 is fixed in relation to the side wall 175 along the X and Y axes as represented by Arrows X and Y, respectively. The lamp socket 105 is also fixed along the z-axis by contact between the lamp socket and the platform. However, the lamp socket 105 can tilt forward and backward since the springboard 115 is in contact with the top region 150 although the platform 120 reduces or restricts the forward rotation of the socket 105 away from the wall 175.

The platform 120 also may be configured similarly to the spring board 115. For example, platform maybe replaced with a spring board 115 that is oriented in the opposite direction so that the combination of the spring boards fixes the socket 105 in position but yet permits movement of either or both of the top or the bottom of the socket 105 in the direction of the wall 127.

In another implementation, the retention clip 110 may have a triangular shape along its length with a channel to insert the insert wings 140. In this implementation, the lip may not be necessary since the insert wings flare outward into the channel, preventing movement up, down or sideways (along the X and Y axes) of the lamp socket 105.

Figure 8:
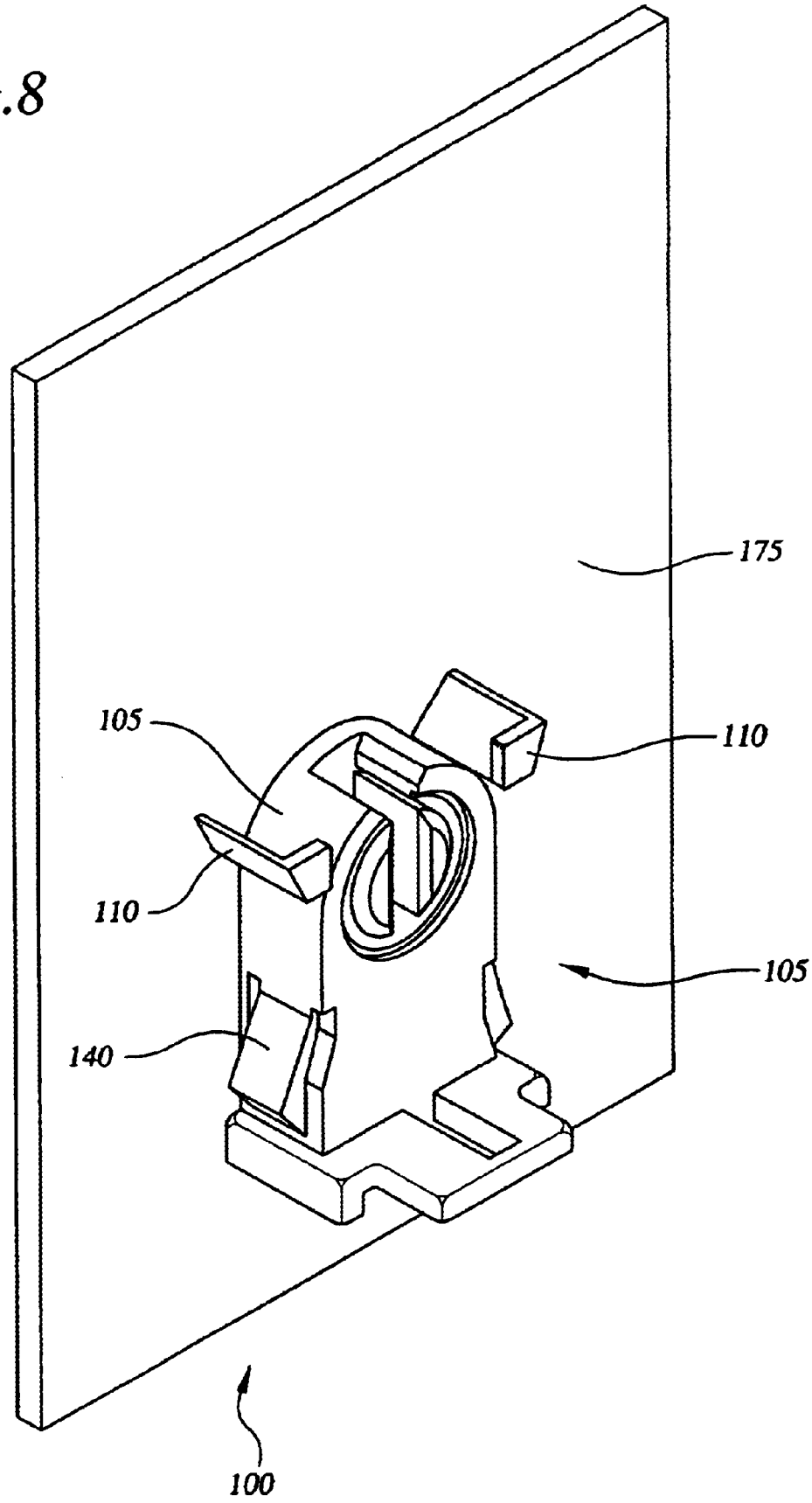
FIGS. 8–10 are a series of diagrams illustrating different points in the installation of a lamp length compensation system in a light fixture side wall.
Figure 9:
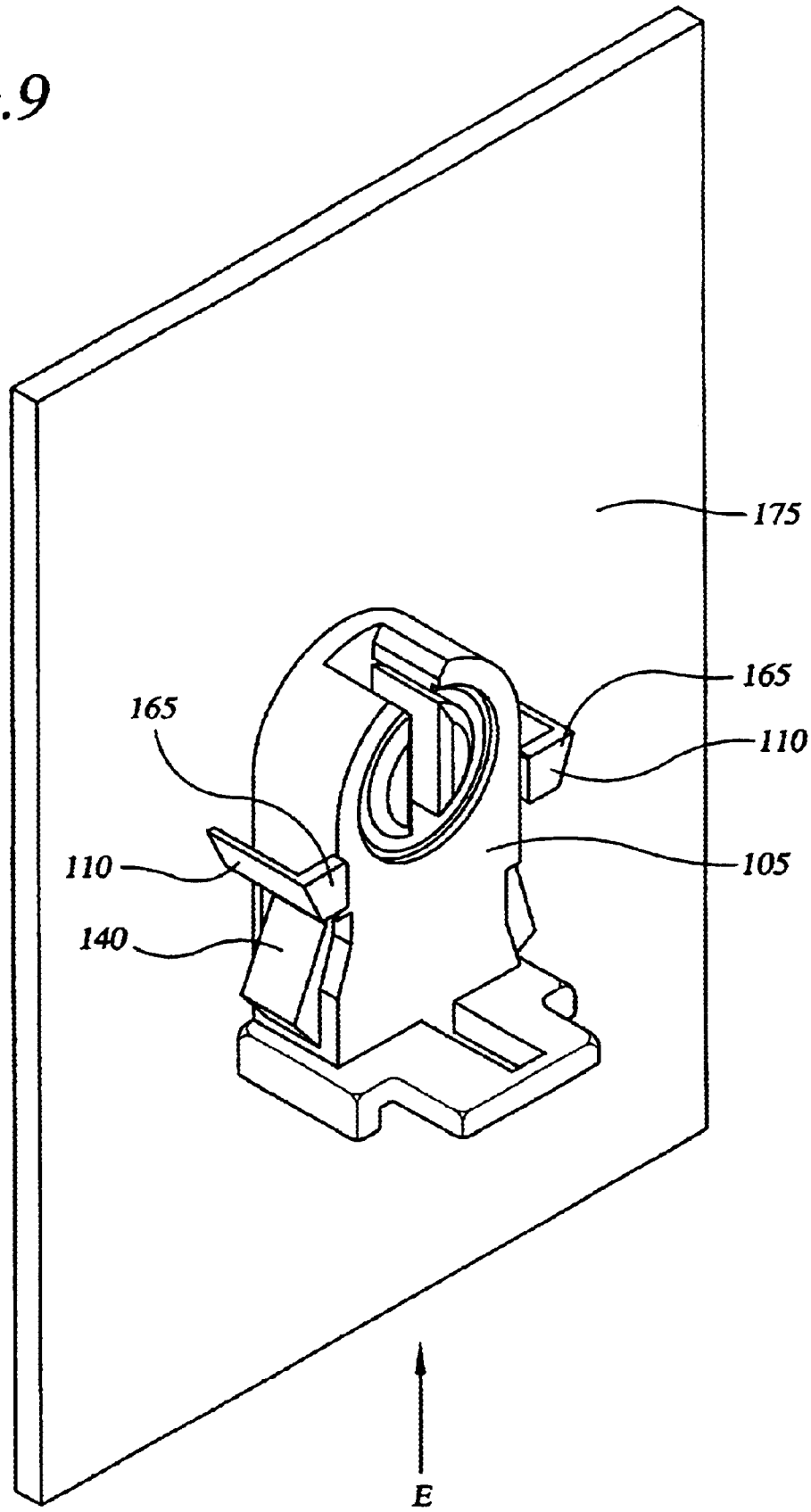
Figure 10:
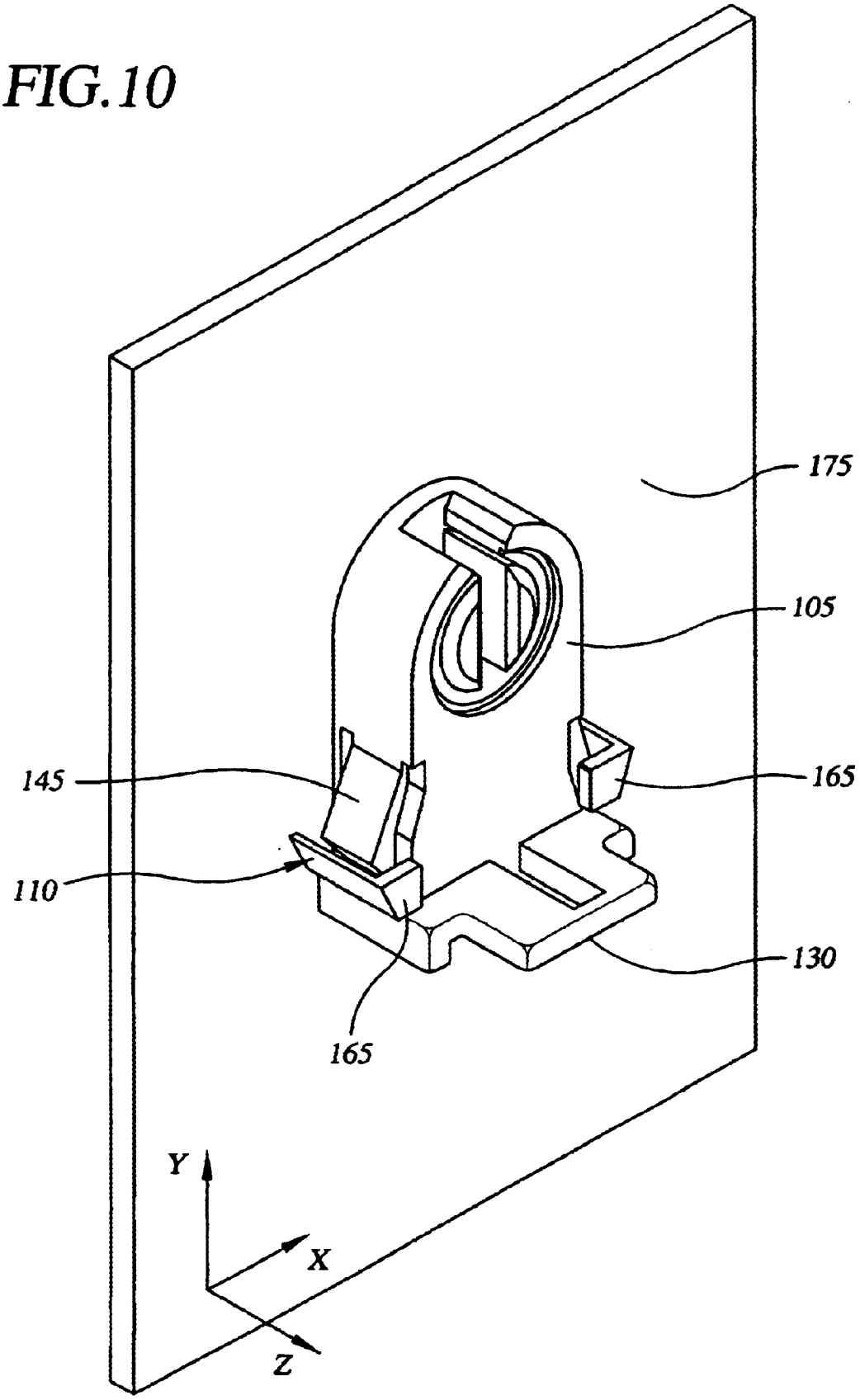

Referring to FIGS. 8–10, installing the lamp length compensation system 100 includes lining up the lamp socket 105 with the insert wings 140 beneath the retention clips 110 (FIG. 8), inserting the lamp socket 105 between the retention clips 110 until the insert wings 140 contact the retention clips 110 (in the direction represented by Arrow E, FIG. 9), flexing the insert wings 140 inward, which reduces the profile of the socket, sliding the lamp socket 105 between the retention clips 110, and slideably fixing the lamp socket 105 into position by fixing the outwardly expanded insert wings 140 into position above the retention clips 110 and the lip 130 below the retention clips 110 (FIG. 10). In this position, the lamp socket 105 tilts forward and backward along the z axis (represented by Arrow Z) between the side wall 175 and the movement stop 165.

Once the lamp socket 105 is slideably fixed into the retention clips 110, the lamp socket 105 cannot be easily or accidentally removed from the retention clips 110. The fixed position of the lamp socket results from the outward expansion of the flexible insert wings 140 above the retention clips 110, which prevents the lamp socket 105 from sliding downward or from being pulled downward through the retention clips 110, and the lip 130, which is sized to prevent the lamp socket 105 from sliding upward or being pulled upward and through the retention clips 110. However, the lamp socket 105 can slide or tilt along the length of the retention clips 110 between the side wall 175 and the movement stops 165.

In another implementation, the lamp socket 105 is held in a fixed position along the z axis between the side wall 175 and the movement stop 165 by installing a platform 120 that is sized such that the lamp socket 105 is wedged tightly in place between the platform 120 and the movement stops 165. Thus, the lamp socket 105 may tilt forward and backward without sliding along the retention clips 110. The platform 120 also can be configured as a flexible spring board, as describe above, to more further wedge the lamp socket in place yet still provide lamp length compensation over a range of lamp lengths.

Figure 11:
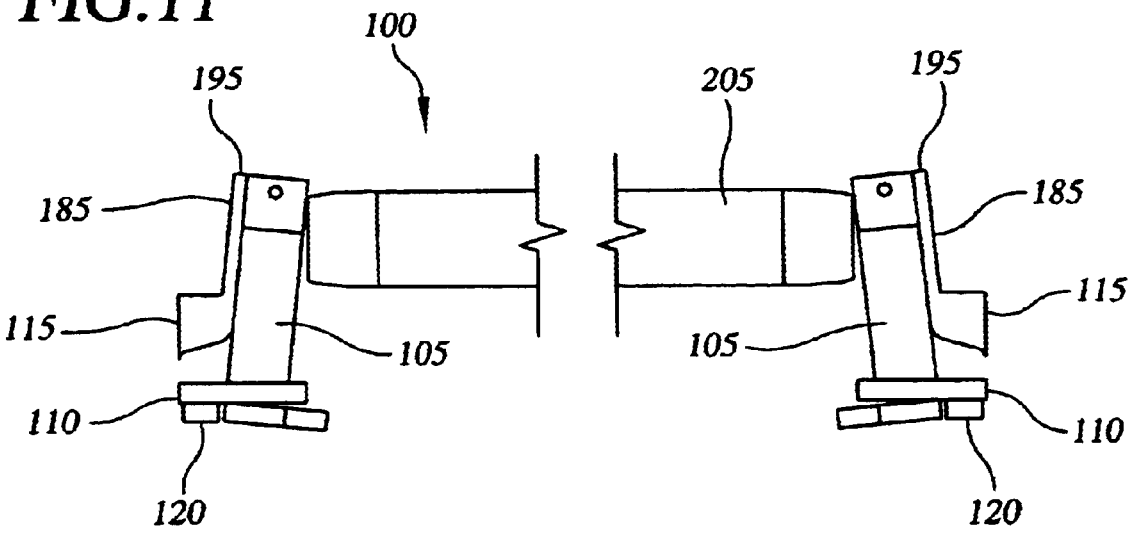
FIGS. 11 and 12 are perspective views of a fluorescent lamp installed in a lamp length compensation system.

FIG. 11 shows the lamp length compensation system 100 with a shorter length fluorescent lamp 205 installed. With the shorter lamp 205 installed, the tip 195 of the lever 185 pushes the lamp socket toward the middle of the lamp 205. Thus, the lamp socket 105 tilts inward to accommodate the smaller sized lamp 205.

Figure 12:
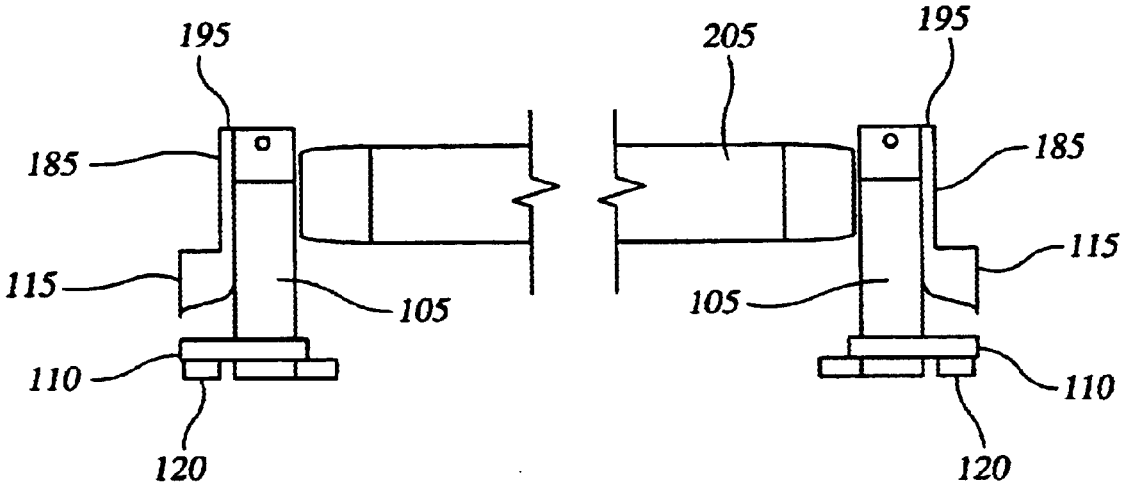

FIG. 12 shows the lamp length compensation system 100 with a relatively longer fluorescent lamp 205 installed. As shown, the additional length of the lamp 205 causes the tip 195 of the lever 185 to flex backward in a direction toward the lamp side wall 175 (not shown). Thus, as the length of an installed lamp 205 increases, the lamp socket 105 tilts further backward toward the side wall 175.

The lamp length compensation system 100 can be manufactured from plastic by injection molding. In other implementations, the system 100 components are made by compression molding, extrusion, or casting. The components may be separately manufactured and fixed together or they may be formed as an integral system. For example, the springboard 115, retention clips 110, and platform 120 may be molded as part of the side wall 175. In another implementation, the top region 150 of the lamp socket 105 may be formed separately and fixed to the lamp socket 105 after the contact retainer 145 is installed.

Figure 13:
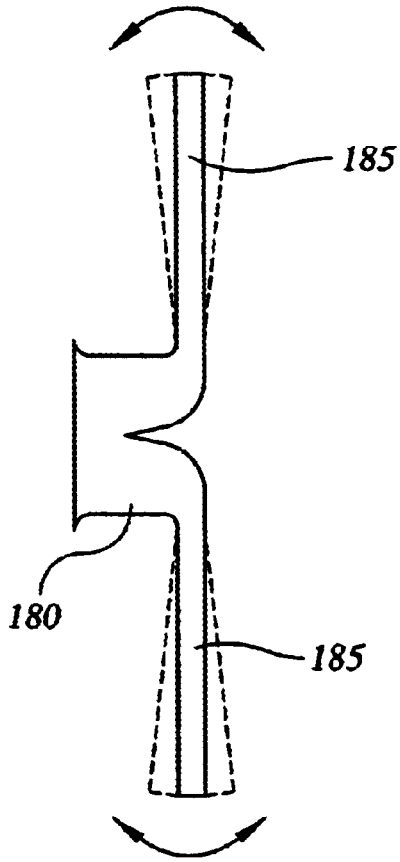
FIG. 13 is a side view of a springboard having two levers extending from a single base.

A number of implementations have been described. Nevertheless, it will be understood that various modifications may be made. For example, the springboard 115 may be configured with a flat portion that can be attached to a wall of a building at the end opposing the tip 195. In this implementation, the lamp length compensation system can be used without the need for attachment to a lamp fixture side wall. In a further implementation, both ends of the springboard may attach to the lamp side wall and the middle of the springboard may bow outward toward the center of the lamp fixture. The system also may be configured to have a springboard 115 that has two levers 185 extending from the single base 180 to press against the lamp socket at opposite ends of the lamp socket. For example, as illustrated in FIG. 13, the levers 185, which function as independent spring boards, are attached to the single base 180 and are oppositely oriented to evenly press against the socket in an outward direction. This arrangement allows the lamp length compensation system 100 to accommodate variations in length of different types of lamps while minimizing tilting of the lamp socket 105. In yet another implementation, the platform is omitted, allowing the lamp socket 105 more travel along the z axis and the lamp socket is retained and supported by the interaction between the retention clips 110 and the insert wings 140 and the lip 130. Accordingly, other implementations are within the scope of the following claims.

What is claimed is:

1. A lamp length compensation system comprising:

a lamp socket having a first end, a second end, and a lamp contact at the first end;

a retention clip having a movement stop, the retention clip being mountable to a wall to pivotally retain the second end of the lamp socket between the wall and the movement stop; and a flexible member mountable to the wall, the flexible member contacting the lamp socket for urging the first end of the lamp socket a variable distance away from the wall to accommodate lamps of different lengths.

2. The lamp length compensation system of claim 1 wherein the retention clip comprises a pair of retention clips.

3. The lamp length compensation system of claim 1 wherein the retention clip comprises a retention wall and a bottom wall and the lamp socket is retained by contact with the retention wall.

4. The lamp length compensation system of claim 1 wherein:

the lamp socket comprises a first side having a first insert wing and a second side having a second insert wing;

the retention clip comprises a pair of retention clips; and the lamp socket is retained by contact between the retention clips and the first and second insert wings.

5. The lamp length compensation system of claim 1 wherein the lamp socket includes a slot to receive one or more lamp contacts.

6. The lamp length compensation system of claim 1 further comprising a platform mountable to the wall and supportedly contacting the lamp socket.

7. The lamp length compensation system of claim 1 wherein the lamp socket comprises a lip that contacts a bottom portion of the retention clip.

8. The lamp length compensation system of claim 1 further comprising a light fixture.

9. The lamp length compensation system of claim 1 wherein the wall comprises a wall of the space to be illuminated.

10. The lamp length compensation system of claim 3 wherein an angle between the retention wall and the bottom wall defines an acute angle.

11. The lamp length compensation system of claim 5 wherein the lamp socket includes a contact retainer to retain the lamp contacts.

12. The lamp length compensation system of claim 6 wherein the lamp socket comprises a base and the platform contacts the base to limit the range of travel of the lamp socket between the wall and the movement stop.

13. The lamp length compensation system of claim 8 wherein the wall comprises a side wall of the lamp fixture.

14. A method of installing a lamp length compensation system, the method comprising:

mounting a retention clip having a movement stop and a flexible member to a wall; and installing a lamp socket having a lamp contact at a first end thereof in the retention clip such that the retention clip pivotally retains a second end of the lamp socket and the flexible member contacts the first end of the lamp socket, whereby the lamp contact is urged a variable distance away from the wall to accommodate lamps of different lengths.

15. The method of claim 14 wherein:

the retention clip comprises a pair of retention clips; and installing the lamp socket in the retention clip includes installing the lamp socket between the retention clips.

16. The method of claim 14 wherein:

the lamp socket comprises a first side having a first insert wing and a second side having a second insert wing;

the retention clip comprises a pair of retention clips; and installing the lamp socket includes contact between the retention clips and the first and second insert wings.

17. The method of claim 14 wherein:

the lamp socket includes a lip; and installing the lamp socket includes retaining the lamp socket by contact between the retention clips and the lip.

18. The method of claim 14 further comprising installing a fluorescent lamp in the lamp socket.

19. The method of claim 14 further comprising mounting a platform to the wall to supportedly contact the lamp socket.

20. The method claim 14 wherein installing the lamp socket comprises:

aligning the lamp socket below the retention clip; and sliding the lamp socket toward the retention clip.

21. The method of claim 18 wherein:

the lamp socket comprises a slot and a contact retainer;

the fluorescent lamp comprises lamp contacts; and installing the fluorescent lamp in the lamp socket includes inserting the lamp contacts in the contact retainers and fixing the contact retainers in the lamp socket.

22. A light fixture comprising:

a wall; and a lamp length compensation system comprising:

a pair of retention clips mounted to the wall for pivotally retaining a first end of a lamp socket; and a flexible member attached to the wall for urging a second end of the lamp socket a variable distance away from the wall to accommodate lamps of different lengths.

23. The lamp fixture of claim 22 wherein:

the retention clips are configured to slideably retain a lamp socket; and the flexible member is configured to flexedly contact the lamp socket.

24. The lamp fixture of claim 23 wherein:

the retention clips each comprise a movement stop; and the retention clips slideably retain the lamp socket between the wall and the movement stops.

25. The lamp fixture of claim 22 wherein:

the flexible member comprises a springboard having a base and a lever; and the base is mounted to the wall and the lever is configured to flexedly contact the lamp socket.

26. A light fixture, comprising:

a pair of facing walls;

a pair of lamp sockets, arranged on opposite walls, for receiving a lamp therebetween;

each lamp socket having a lamp contact at one end;

means, extending from each wall, for rotatably-biasing said one end of each lamp socket a variable distance away from the wall to accommodate lamps of different lengths.

27. The light fixture recited in claim 26 wherein the rotatably-biasing means comprises:

a platform extending from each wall; and means for retaining the other end of each lamp socket against the respective platform.

28. The light fixture recited in claim 26 wherein the rotatably-biasing means comprises a spring.

29. The light fixture recited in claim 27, wherein the retaining means comprises at least one retention clip having a movement stop for pivotally retaining the other end of the lamp socket between the platform and the movement stop.

30. The light fixture recited in claim 29 wherein the spring includes a leaf spring.

31. The light fixture recited in claim 27 wherein the rotataby-biasing means further comprises a leaf spring for urging the one end of each lamp socket away from the respective wall.

32. The light fixture recited in claim 28 wherein the rotatably-biasing means further comprises a leaf spring for urging the one end of each lamp socket away from the respective wall.

* * * * *